US010093444B2

(12) United States Patent
Ring et al.

(10) Patent No.: US 10,093,444 B2
(45) Date of Patent: Oct. 9, 2018

(54) LARGE FORMAT CONTAINER

(71) Applicant: RING Container Technologies, LLC, Oakland, TN (US)

(72) Inventors: Carl Ring, Oakland, TN (US); Brian Smith, Oakland, TN (US); Dan Futral, Somerville, TN (US); Doug Dygert, Olive Branch, MS (US)

(73) Assignee: Ring Container Technologies, LLC, Oakland, TN (US)

( * ) Notice: Subject to any disclaimer, the term of this patent is extended or adjusted under 35 U.S.C. 154(b) by 0 days.

(21) Appl. No.: 15/016,410

(22) Filed: Feb. 5, 2016

(65) Prior Publication Data

US 2017/0021956 A1 Jan. 26, 2017

Related U.S. Application Data

(63) Continuation of application No. 29/516,828, filed on Feb. 6, 2015, now Pat. No. Des. 780,587, and a (Continued)

(51) Int. Cl.
*B65D 1/42* (2006.01)
*B65D 1/02* (2006.01)
*B65D 1/46* (2006.01)

(52) U.S. Cl.
CPC ..... *B65D 1/0207* (2013.01); *B65D 1/0223* (2013.01); *B65D 1/42* (2013.01); (Continued)

(58) Field of Classification Search
CPC ..... B65D 1/0207; B65D 1/42; B65D 1/46; B65D 1/45; B65D 1/48
(Continued)

(56) References Cited

U.S. PATENT DOCUMENTS

D403,243 S * 12/1998 Takeuchi ..... D9/532
7,798,349 B2 9/2010 Maczek et al.
(Continued)

FOREIGN PATENT DOCUMENTS

JP 3084931 U 4/2002

OTHER PUBLICATIONS

International Search Report and Written Opinion, issued by International Searching Authority in corresponding international application No. PCT/US2016/016677, dated Apr. 14, 2016.

*Primary Examiner* — Anthony Stashick
*Assistant Examiner* — Raven Collins
(74) *Attorney, Agent, or Firm* — Sorell, Lenna & Schmidt, LLP

(57) ABSTRACT

Provided is a blow molded container including a bottom, four sidewalls extending upward from the bottom to a shoulder region, a neck disposed on the shoulder region and defining an opening at the top of the container, and vertical ribs extending from the shoulder region to the bottom along the sidewalls. The shoulder region includes shoulder ribs and a shoulder base portion, the shoulder ribs formed of should rib walls extending upward from the shoulder base portion and a shoulder rib top portion extending between shoulder rib walls to form an upper part of the shoulder ribs. Each shoulder rib extends from the neck to an upper part of a corresponding vertical rib to provide improved top load resistance at the top and neck of the container.

20 Claims, 16 Drawing Sheets

Related U.S. Application Data continuation of application No. 29/516,834, filed on Feb. 6, 2015, now Pat. No. Des. 779,954, and a continuation of application No. 29/516,830, filed on Feb. 6, 2015, now Pat. No. Des. 779,953, and a continuation of application No. 29/516,827, filed on Feb. 6, 2015, now Pat. No. Des. 779,952, and a continuation of application No. 29/516,826, filed on Feb. 6, 2015, now Pat. No. Des. 779,956.

(60) Provisional application No. 62/196,378, filed on Jul. 24, 2015.

(52) U.S. Cl.
CPC ..... *B65D 1/46* (2013.01); *B65D 2501/0027* (2013.01); *B65D 2501/0036* (2013.01); *B65D 2501/0081* (2013.01)

(58) Field of Classification Search
USPC ..... 215/383, 504
See application file for complete search history.

(56) References Cited

U.S. PATENT DOCUMENTS

| | | | | |
|---|---|---|---|---|
| 7,823,737 | B2 | 11/2010 | Noll et al. | |
| D637,084 | S * | 5/2011 | Kissinger | D9/541 |
| D641,638 | S * | 7/2011 | Stengel | D9/560 |
| 8,746,453 | B1 * | 6/2014 | Hall | B65D 21/0202 206/504 |
| 2008/0223816 | A1 | 9/2008 | Darr et al. | |

* cited by examiner

LARGE FORMAT CONTAINER

CROSS-REFERENCE TO RELATED APPLICATIONS

This application claims the benefit of the co-pending U.S. application Ser. Nos. 29/516,827, 29/516,826, 29/516,830, 29/516,834 and 29/516,828 each filed on Feb. 6, 2015, and provisional U.S. patent application Ser. No. 62/196,378 filed on Jul. 24, 2015.

BACKGROUND OF THE INVENTION

Currently, the large format (1 gallon and up) polyethylene terephthalate (PET) container market consist of heavy containers. These heavy containers are required because the containers are currently tray packed or similarly packaged, so that they depend on their weight based structures to withstand the forces they face during shipping and filling. When looking at large PET containers that must compete against existing polyethylene containers, the weight required to survive the distribution system makes the PET container financially uncompetitive. To be competitive, the weight of current PET containers must be reduced. However, when the amount of material used in the container is reduced, structural weakness can be problematic.

In addition to the stresses encountered with the filling and distribution systems currently in place, a handle may be applied to the container to help with moving and pouring. In the case of a bale handle, an extra downward force in order to attach the bail handle is required either before or after filling. To meet these constraints, containers designed to hold large amounts of product require tall, steeply sloping shoulders making them taller than current polyethylene containers driving up container cost by reducing the number of containers that can be placed in a truck for shipping.

SUMMARY OF THE APPLICATION

It is an aspect of the present application to maintain the size (height) of the current polyethylene containers on the market by providing additional structure to the container to increase the resistance to the stresses of the current filling, distribution and end use systems. The design solves the problems described by incorporating ribs in a shoulder having a small relatively small amount of slope. The shoulder ribs are connected to vertical ribs that run down the sidewall of the container to transfer the load to the standing surface. The shoulder ribs transform from outward facing on the shoulder to inward facing vertical ribs running down the side panels. In addition, smaller ribs may be placed along the side to the larger vertical panel ribs to give additional stability to the structure.

According to one aspect of the application, provided is a large format blow molded container including a bottom; four sidewalls extending upward from the bottom to a shoulder region; a neck disposed on the shoulder region and defining an opening at the top of the container; and vertical ribs extending from the shoulder region to the bottom along the sidewalls. The shoulder region includes shoulder ribs and a shoulder base portion, the shoulder ribs formed of shoulder rib walls extending upward from the shoulder base portion and a shoulder rib top portion extending between shoulder rib walls to form an upper part of the shoulder ribs, and each shoulder rib extends from the neck to an upper part of a corresponding vertical rib.

According to another aspect of the application, one shoulder rib extends from the neck to a point of intersection between two adjacent sidewalls and another shoulder rib extends from the neck to a point of intersection between the other two adjacent sidewalls and the corresponding vertical rib for each of the shoulder ribs extends along the point of intersection of the adjacent sidewalls.

According to another aspect of the application, one shoulder rib extends from the neck to a middle portion of one of the sidewalls and another shoulder rib extends from the neck to a middle portion of a sidewall opposite the one of the sidewalls and the corresponding vertical rib for each of the shoulder ribs extends downward along the middle portion of the corresponding sidewall.

According to another aspect of the application, a corresponding shoulder rib extends from the neck to a point of intersection between each of two adjacent sidewalls of the four sidewalls and a corresponding vertical rib for each of the shoulder ribs extends along the point of intersection of the adjacent sidewalls.

According to another aspect of the application a corresponding shoulder rib extends from the neck to a middle portion of each of the sidewalls and the corresponding vertical rib for each of the shoulder ribs extends downward along the middle portion of the corresponding sidewall.

According to another aspect of the application, the shoulder ribs have a convex shape and the corresponding vertical ribs have a concave shape.

According to another aspect of the application, the shoulder ribs have a convex shape and the corresponding vertical ribs are comprised of a plurality of convex and concave shapes.

According to another aspect of the application, two adjacent shoulder rib portions are joined by a shoulder bridge portion extending between the adjacent shoulder ribs and the height of the shoulder bridge portion is the same as the height of the adjacent shoulder ribs.

BRIEF DESCRIPTION OF THE DRAWINGS

The above and other features and aspects of the present invention will become more apparent by describing non-limiting exemplary embodiments thereof with reference to the attached drawings in which.

DETAILED DESCRIPTION OF THE EXEMPLARY EMBODIMENTS

The PET blow molded container according to non-limiting exemplary embodiments of the present invention will now be described more fully with reference to the accompanying drawings. Furthermore, the specific dimensions described below are for an exemplary embodiment and it should be appreciated that the dimensions could be scaled while still being within the scope of the present invention.

The various embodiments described below maintain the size of the current polyethylene containers on the market, but provide additional structure to the container to increase the resistance to stresses incurred as a result of current filling, distribution and end use systems, including bail handle application. The design solves the problems described by incorporating ribs in the shoulder, so that a shoulder of relatively small slope can support the required loads with minimum displacement. These shoulder ribs connect to vertical ribs that run down the sidewall of the container in order to transfer the load to the standing surface. As the neck portion of the container experiences substantially downward loads and stress, it is desired to reduce the displacement of the neck 20 under a downward force or load.

Generally, the ribs transform from outward facing on the shoulder to inward facing running down the side panels. Smaller ribs are placed along the side to the larger vertical panel ribs to give more stability to the structure. The shoulder ribs can be placed in various orientations but the preferred method is to place them perpendicular to the side panels to reduce their length as much as possible. The cross section of the ribs should be as close to a box section as possible. The radii that connect the top of the rib to the sidewall of the rib and from the sidewall of the rib to the shoulder surface must be small enough and the rib profile tall enough to allow a vertical wall between the top of the rib and the shoulder surface. The vertical panel ribs are as wide as the shoulder ribs and transition to a concave form as the rib wraps over the shoulder to the container side panel. The smaller side panel ribs are placed to blend in with the vertical wall of the shoulder rib.

Figure 1:
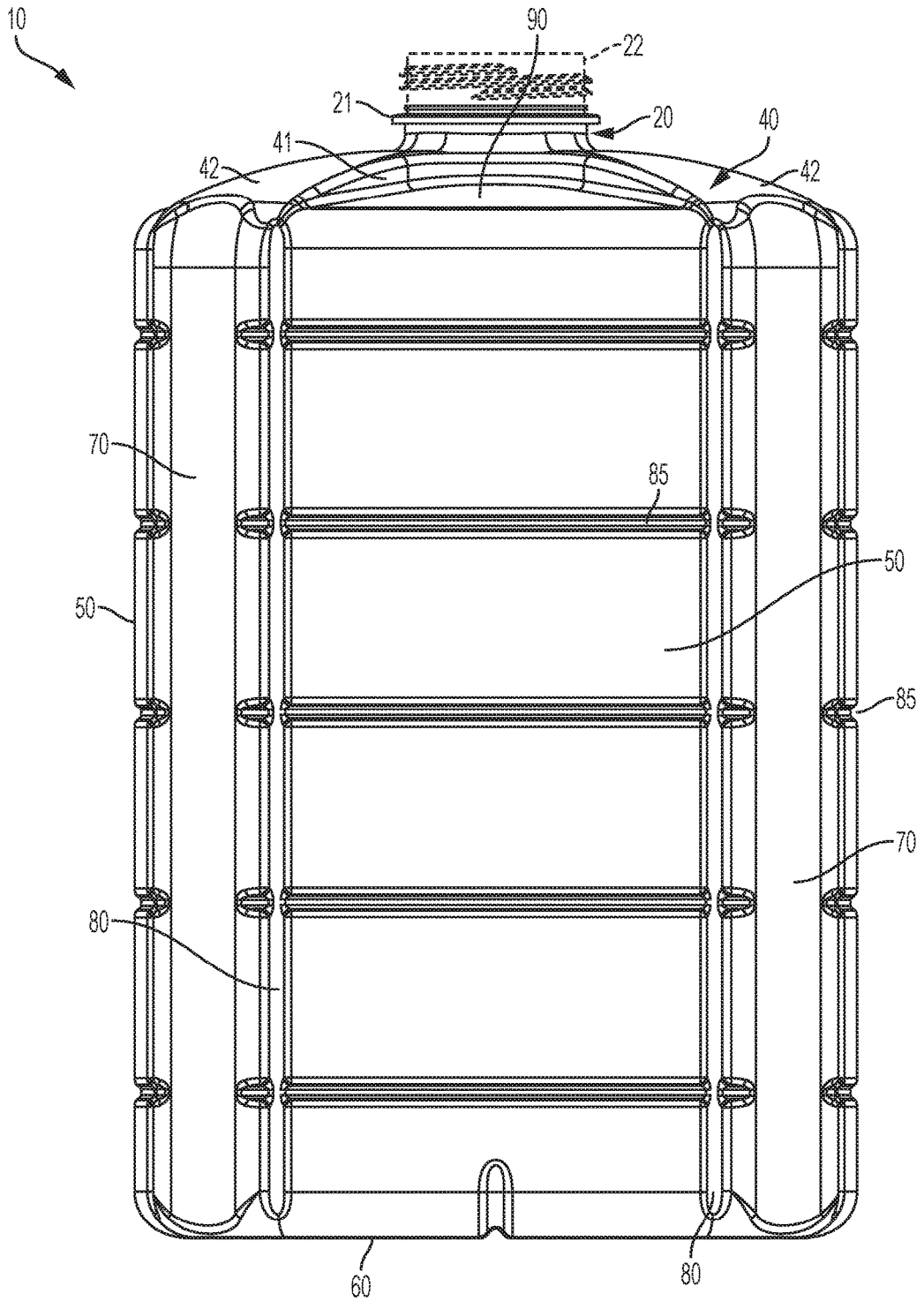
FIG. 1 is a front view of a container according to a first embodiment.
Figure 2:
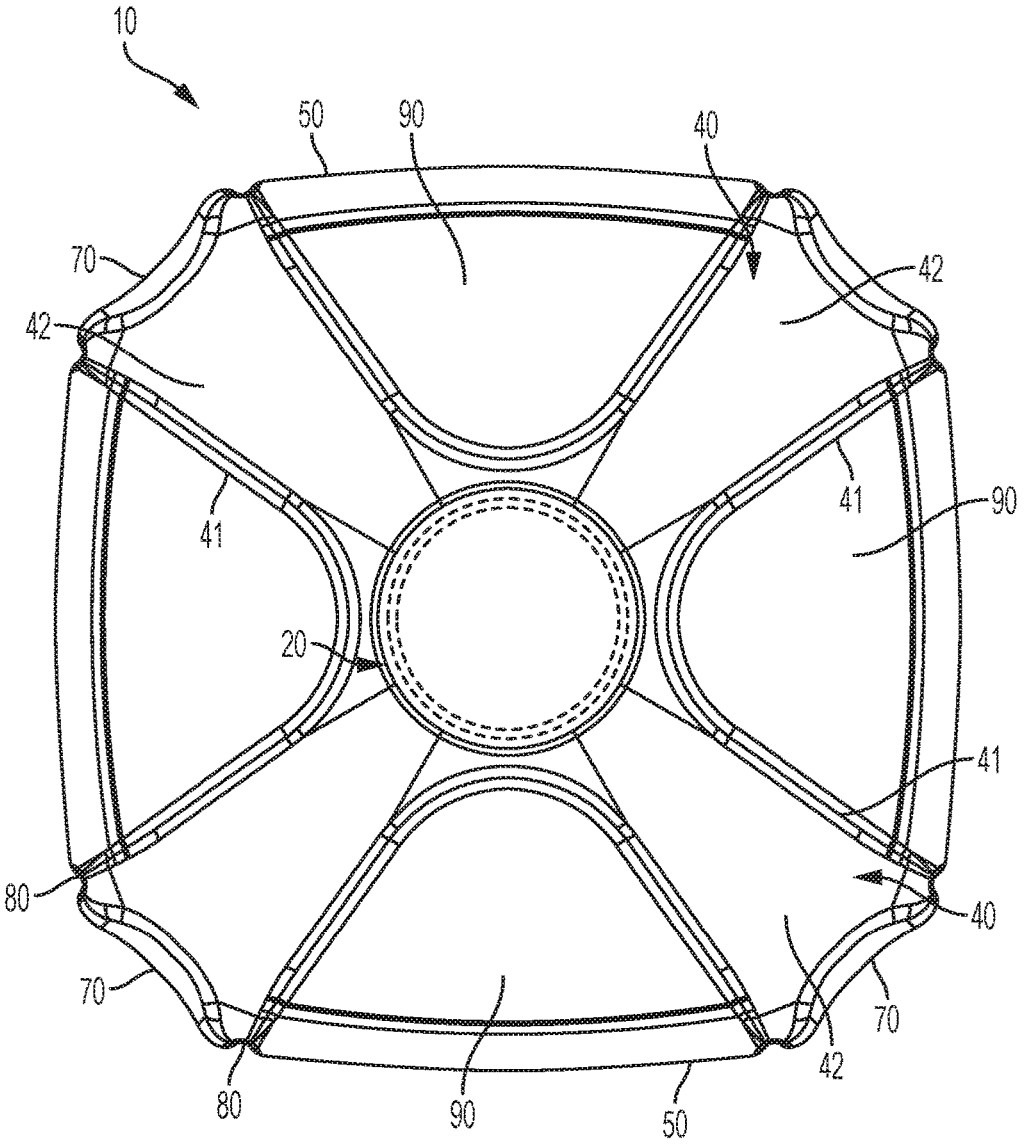
FIG. 2 is a top view of a container according to the first embodiment.
Figure 3:
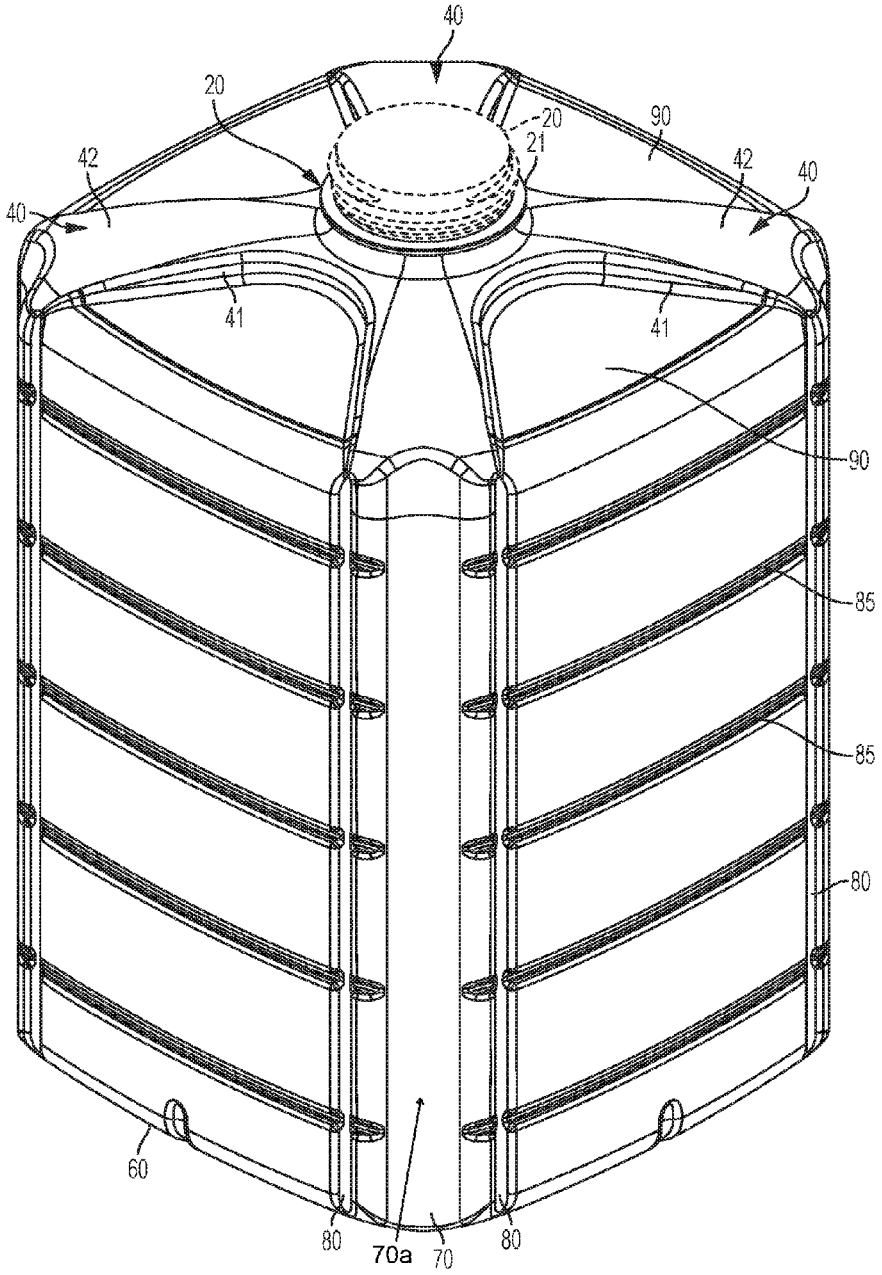
FIG. 3 is a perspective view of a container according to the first embodiment.
Figure 4:
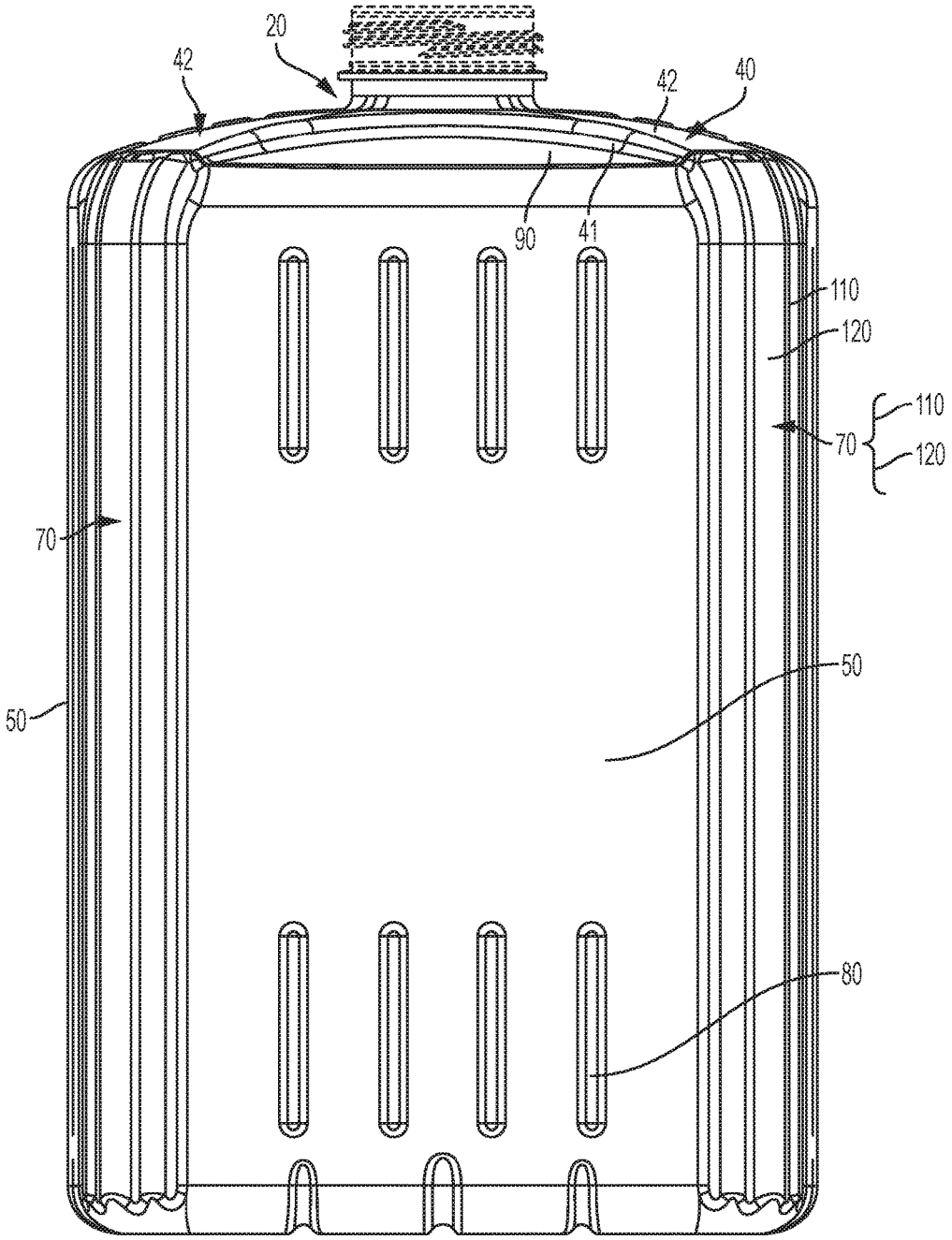
FIG. 4 is a front view of a container according to a second embodiment.
Figure 5:
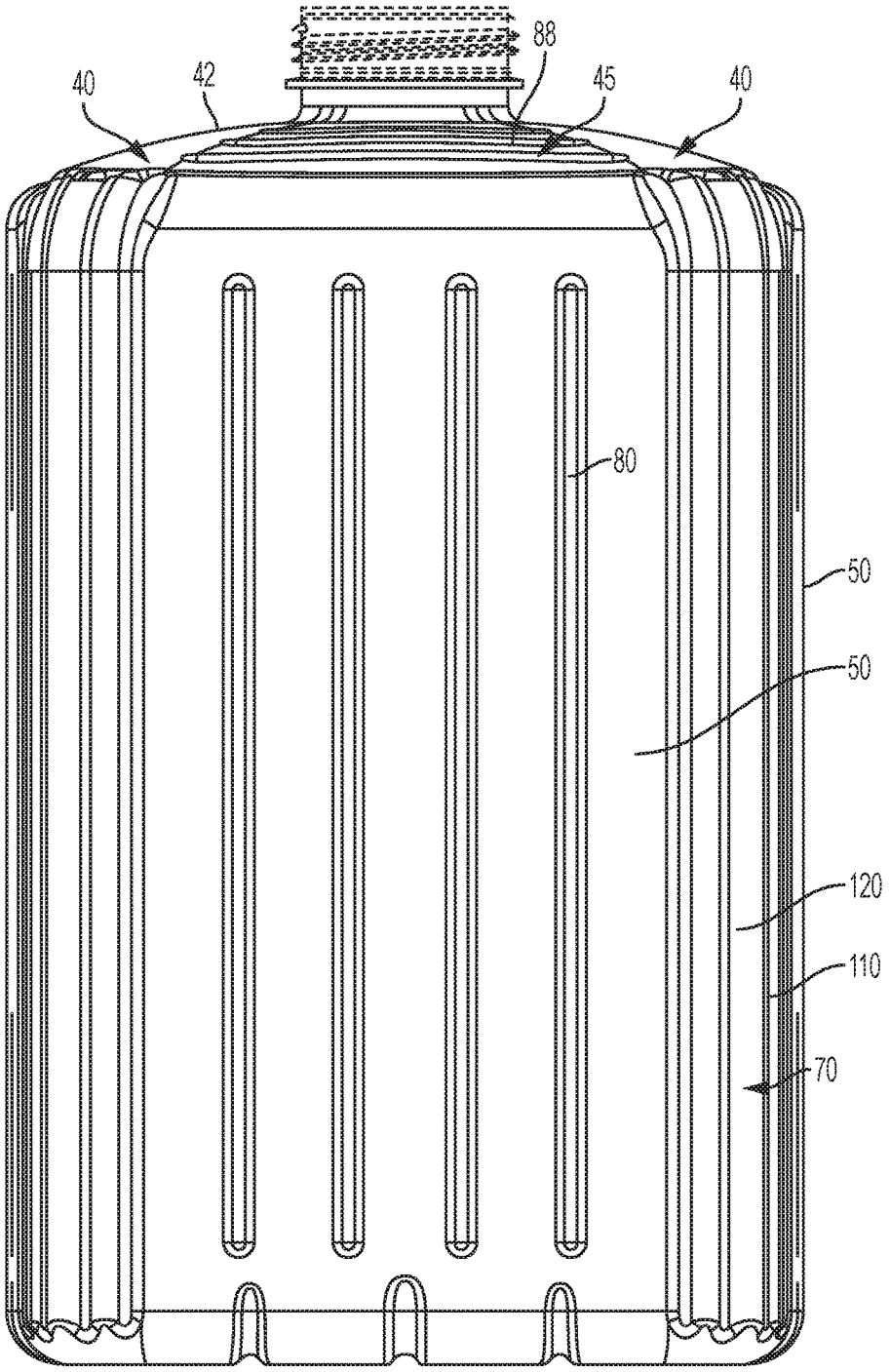
FIG. 5 is a side view of a container according to the second embodiment.
Figure 6:
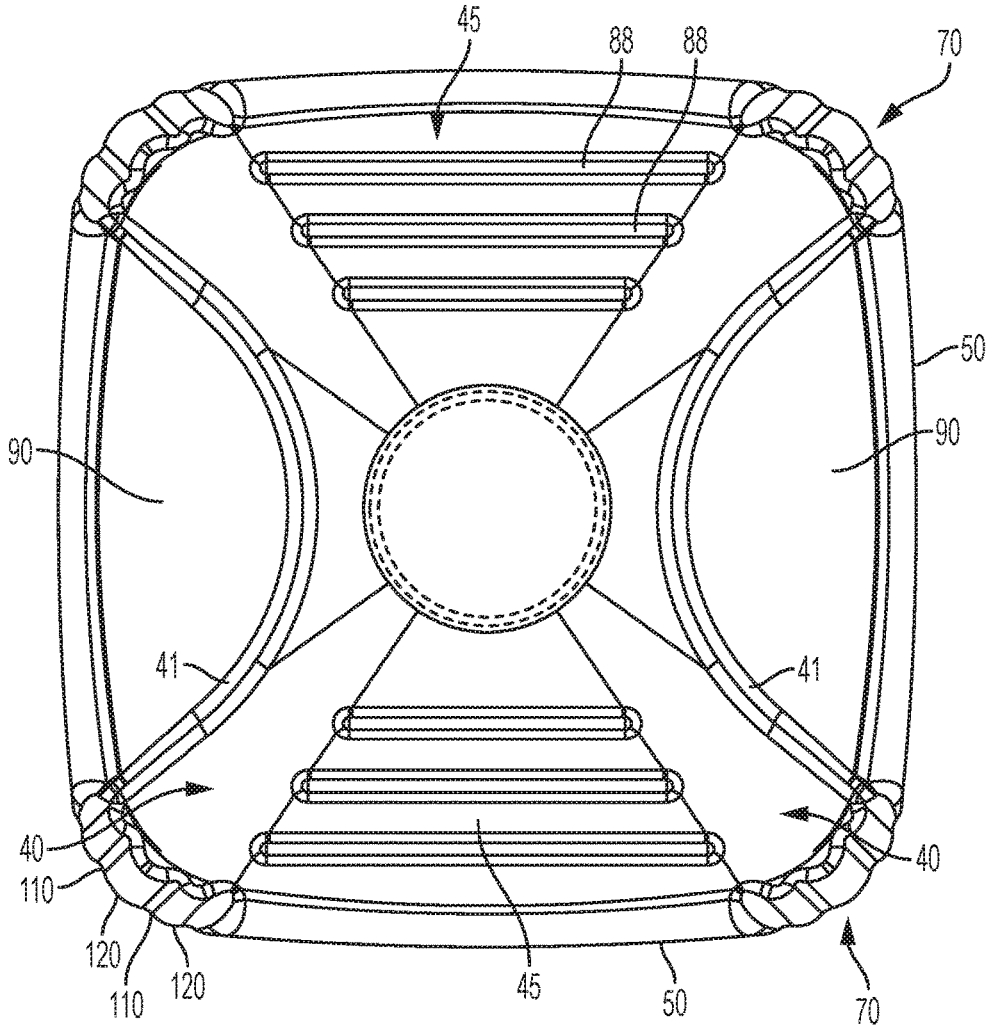
FIG. 6 is a top view of a container according to the second embodiment.
Figure 7:
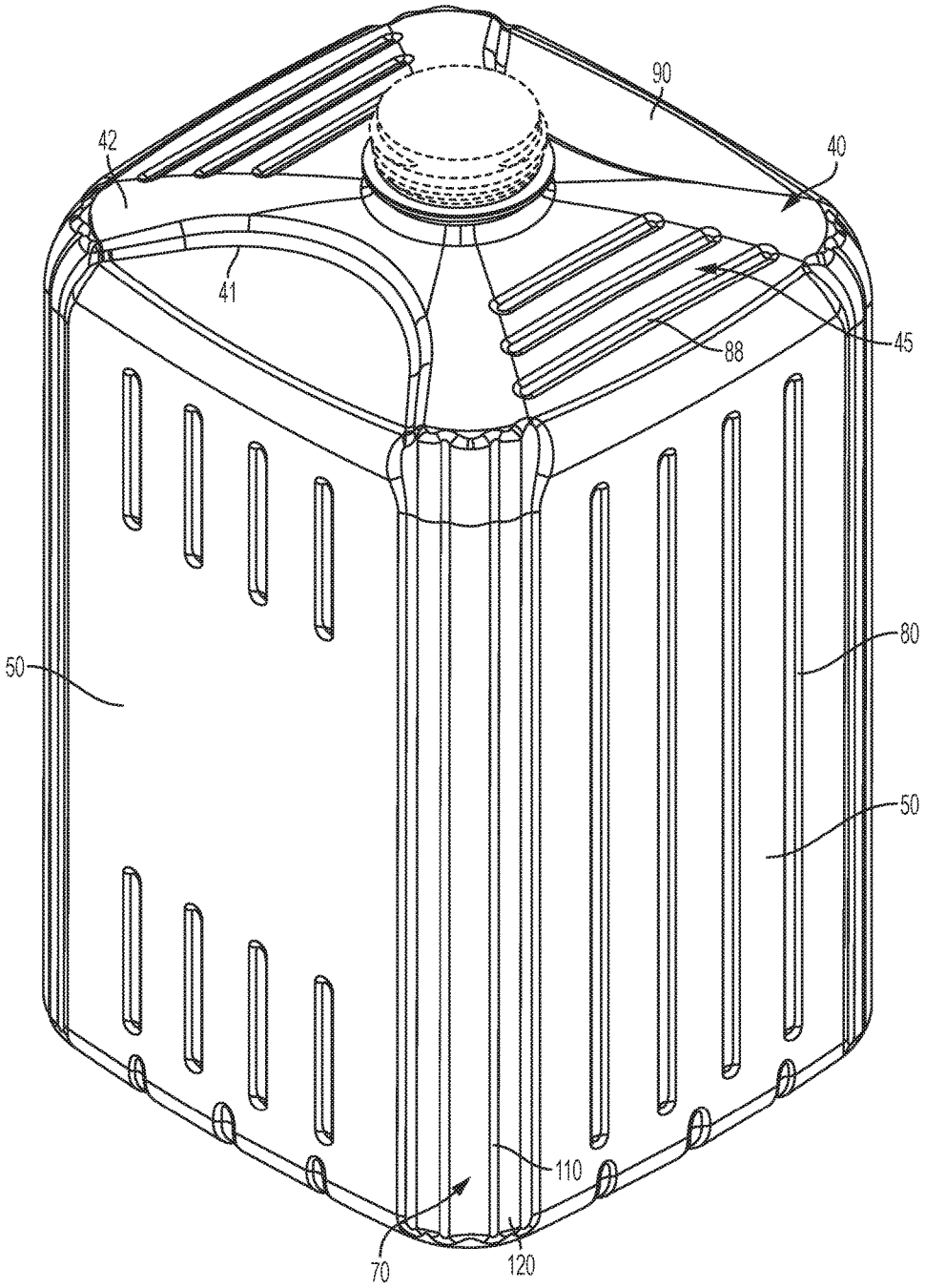
FIG. 7 is a perspective view of a container according to the second embodiment.

With reference to FIGS. 1-3, the first embodiment is a PET container 10 having a neck 20 at the top of the container 10. The neck 20 may include a threaded portion 22 for applying a lid and also may include a bail ring 21 that is configured to receive and support a bail handle (not shown). Neck 20 adjoins a shoulder portion 35 extending laterally outward from the neck having a relatively shallow slope. To improve the strength of the shoulder portion 35 with regard to a downward force on the neck, the shoulder portion 35 includes four shoulder ribs 40 extending from the neck portion 35 toward side walls 50 of the container. In this embodiment (FIG. 2), the container includes four sidewalls and each of the shoulder ribs 40 extend toward an intersecting portion of two adjacent sidewalls 50. While the present invention is not so limited, the container 10 of the embodiments described herein weigh 150 g, has an average sidewall and shoulder thickness of 0.012", a neck finish thickness of 0.060". The radius between the neck and the shoulder portion has a thickness of 0.030". However, these thicknesses may be within a range of 0.009-0.018" (shoulder), 0.045-0.075" (neck finish) and 0.015-0.045" (shoulder).

Each shoulder rib 40 includes a shoulder rib wall 41 extending substantially vertically from a shoulder base portion 90 along each side of the rib 40. The shoulder rib walls 41 on each side the shoulder rib 40 are connected by a shoulder rip top 42. The shoulder rib top 42 may be relatively flat, but has a convex shape in this embodiment. Additionally, the sidewalls 41 of adjacent shoulder ribs may abut each other just prior to converging on the neck. Each shoulder rib wall 41 has a maximum height at point nearest the neck 20 and this height decreases as the shoulder rib 40 approaches the sidewalls 50 of the container 10. As is shown in the figures, each shoulder rib 450 forms a convex portion on the top of the shoulder portion 35 of the container. The shoulder rib wall 40 provides structural support for the neck top load by transmitting this force to the vertical ribs. The height of the shoulder rib walls 41 from the base shoulder portion 90 ranges from 0.650" at portions adjoining the neck and decreases to 0.250" at the shoulder edge adjacent the vertical rib. This range could be as low as 0.125" near the shoulder edge and as high as 0.675" adjacent the neck. However, the rib wall height may be constant from the neck to the shoulder portion within a height range of 0.250"-0.675".

On a distal portion of the shoulder rib 40, distant from the neck 20, there is a transition from a convex shoulder portion to a concave vertical rib 70 that extends from the shoulder portion 35 to the bottom 60 of the container 10. This vertical rib 70 has a radius of curvature of 1.325" and can range from 0.75-3" and still adequately function to support the load transmitted from the shoulder rib 40 to the bottom of the container 10.

In addition to the vertical ribs 70 at the corners of the container 10, smaller sidewall vertical ribs 85 and sidewall horizontal ribs 80 may be included to provide for additional support. These ribs are substantially smaller in width than the vertical ribs 70 that are disposed on the corners of intersecting side walls of the container. In this embodiment, a sidewall vertical rib 85 is placed on either side of each vertical rib 70. The sidewall horizontal ribs 80 are spaced intermittently from the top to bottom along the sidewalls 50. As shown in FIG. 3, for example, vertical ribs 70 each include a central portion **70*a* positioned between adjacent horizontal ribs 80. Portions 70*a* each extend from bottom 60 to shoulder portion 35**.

Another embodiment is shown in FIGS. 4-7. In this embodiment, the shoulder rib portion 40 includes a shoulder rib wall 41 and a shoulder rib top 42. However, each of two pairs of the shoulder rib portions 40 are connected by a shoulder bridge portion 45 that connects two shoulder rib portions 40. Additionally, this shoulder bridge portion 45 may include horizontal shoulder ribs 88 extending substantially parallel to the sidewalls 50. Thus, each shoulder rib portion 40 is defined by a shoulder rib wall 40 and a shoulder bridge portion 45. The shoulder bridge portion extends from one shoulder rib top 42 to an adjacent shoulder rib top 42. Otherwise, the shoulder rib walls 41 extend from the shoulder rib top 42 to a base shoulder portion as in the prior embodiment. The shoulder rib wall 40 provides structural support for the neck top load by transmitting this force to the vertical ribs. The height of the shoulder rib walls 41 from the based shoulder portion is similar to the other embodiments.

Another difference in this embodiment is that the vertical ribs include multiple concave 110 and convex portions 120 to provide structural support for the shoulder ribs 40. Additionally, the sidewalls include multiple vertical sidewall ribs 80.

Figure 8:
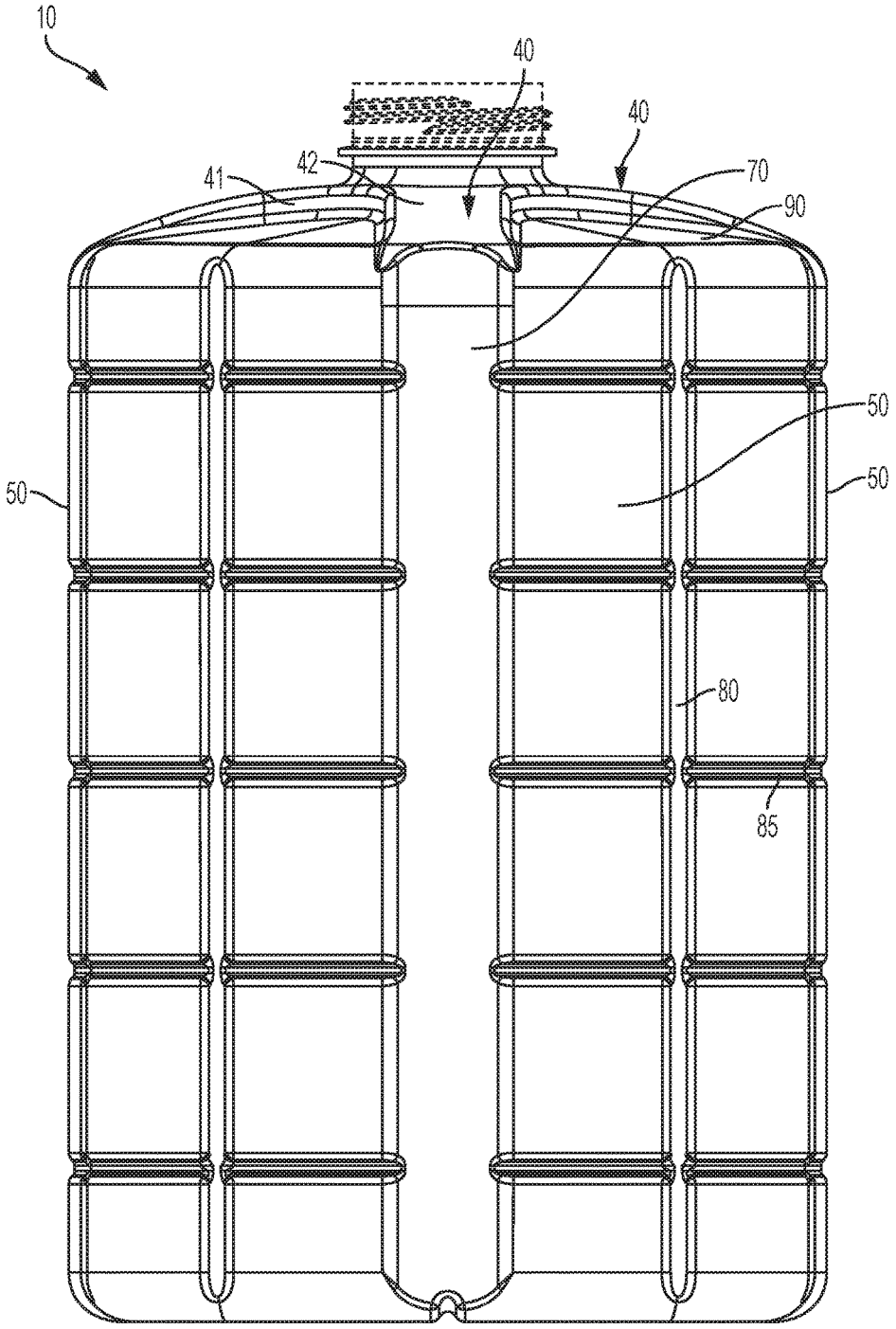
FIG. 8 is a front view of a container according to a third embodiment.
Figure 9:
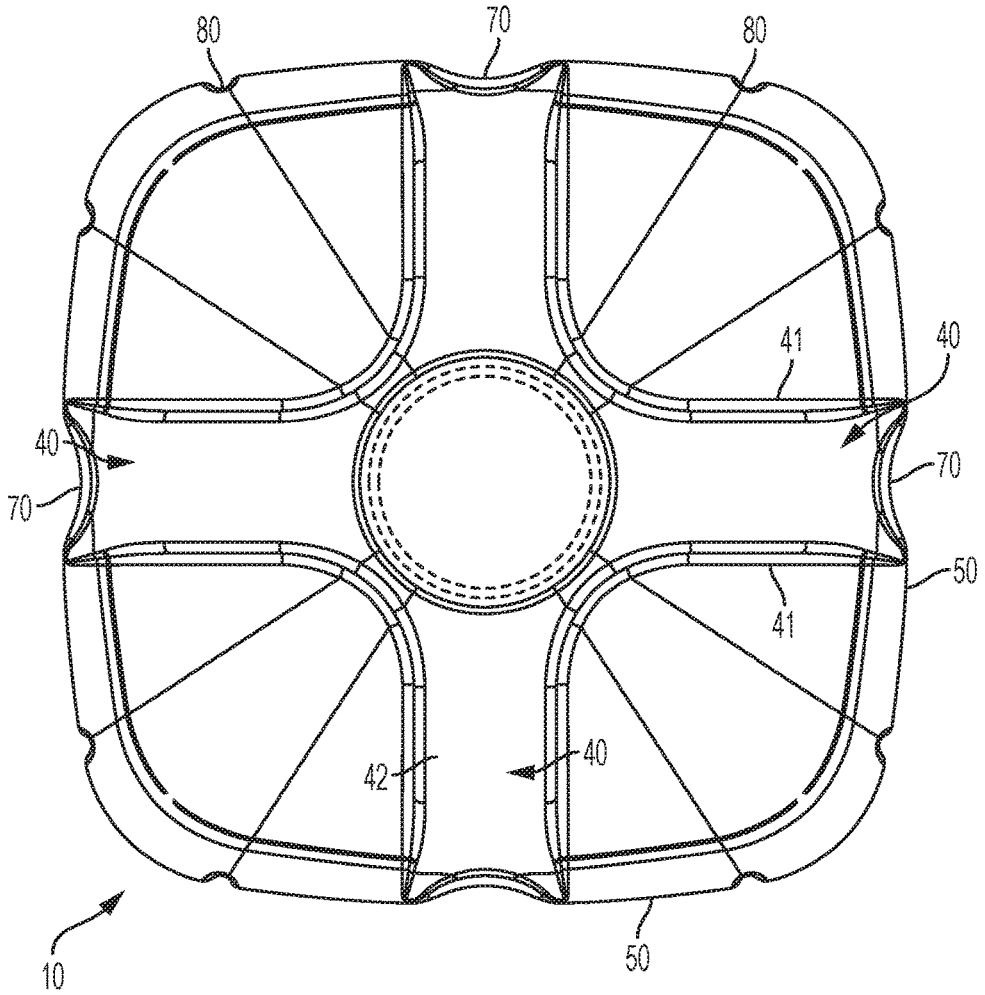
FIG. 9 is a top view of a container according to the third embodiment.
Figure 10:
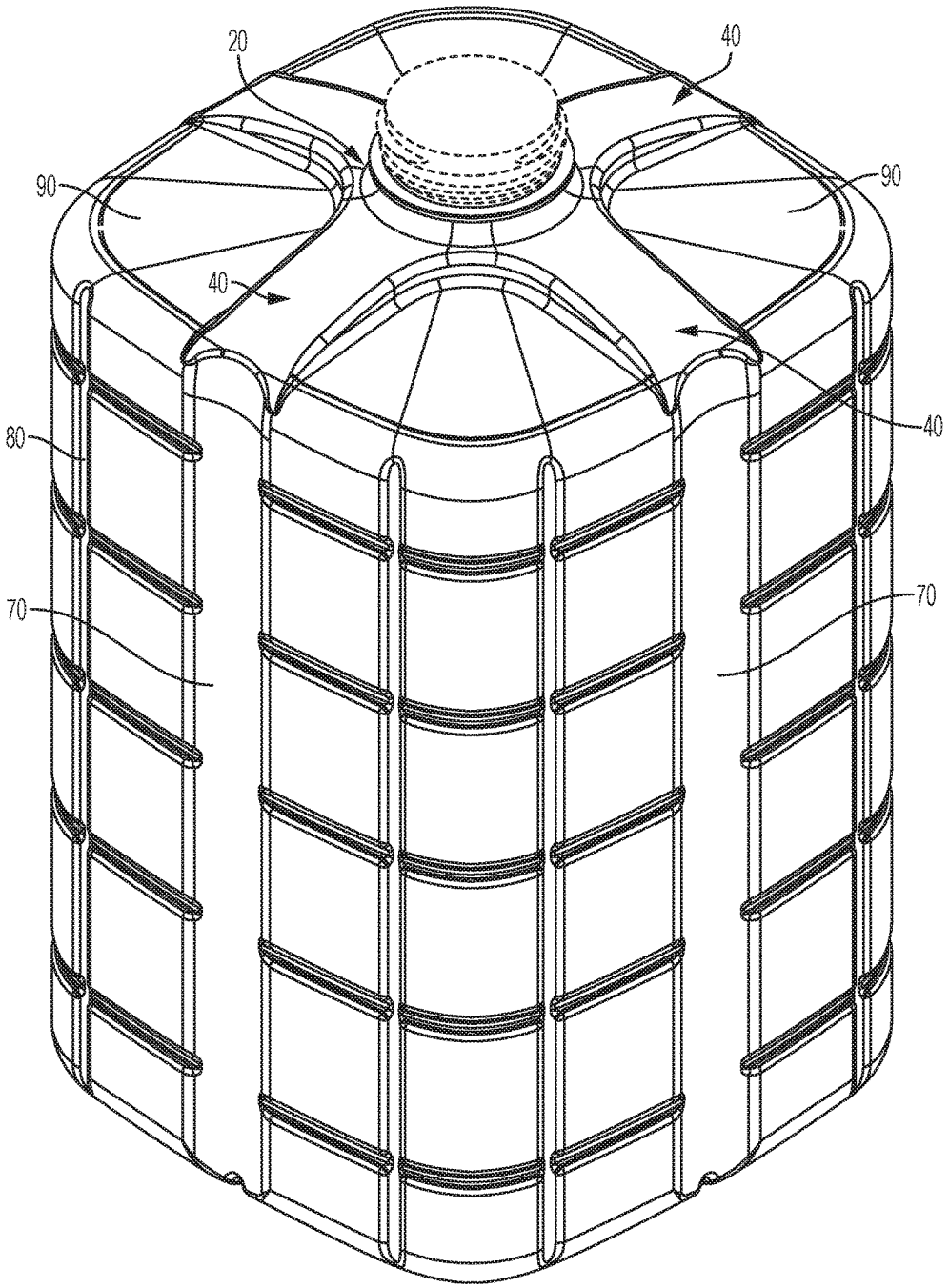
FIG. 10 is a perspective view of a container according to the third embodiment.
Figure 11:
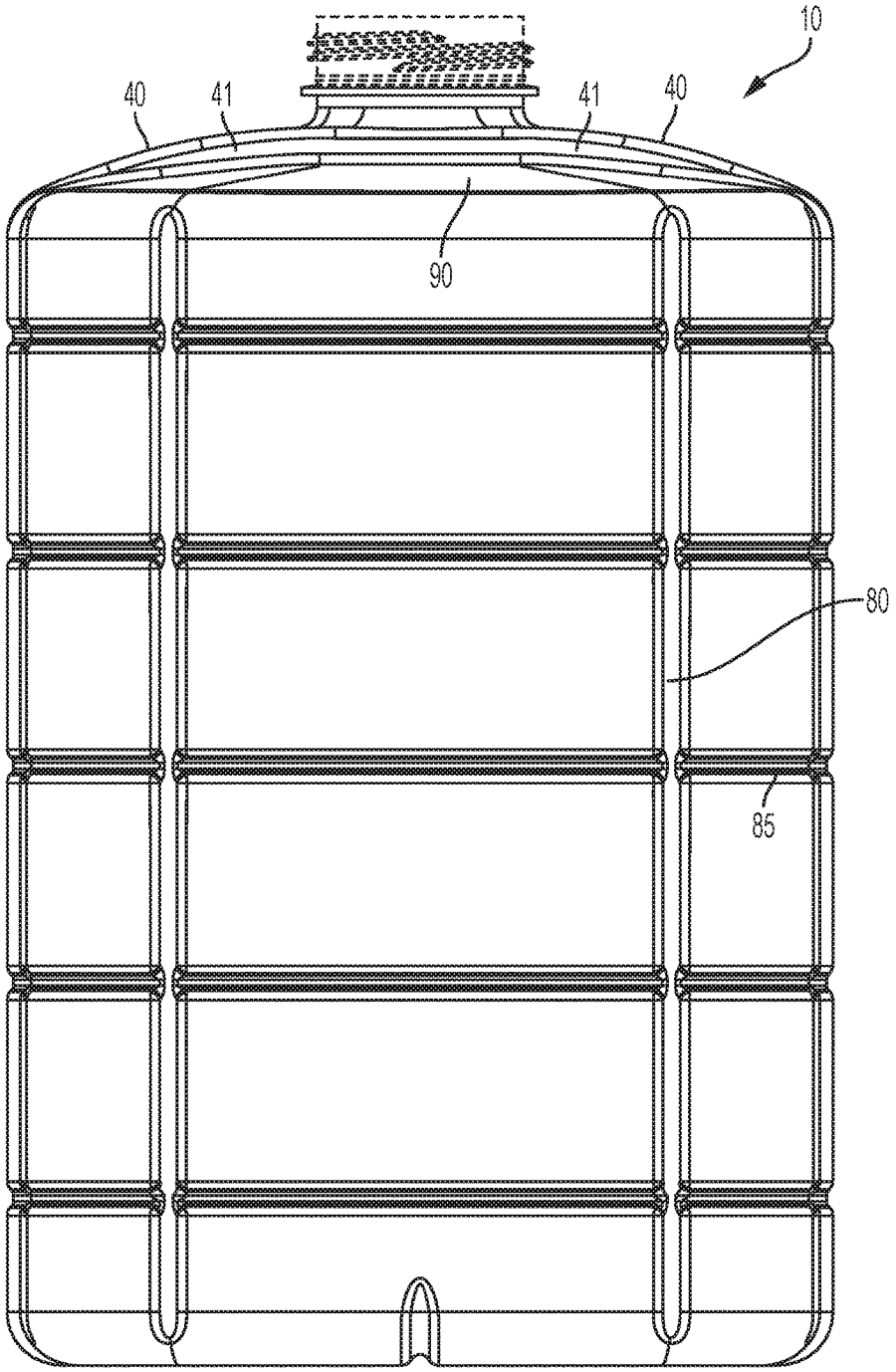
FIG. 11 is a front view of a container according to a fourth embodiment.
Figure 12:
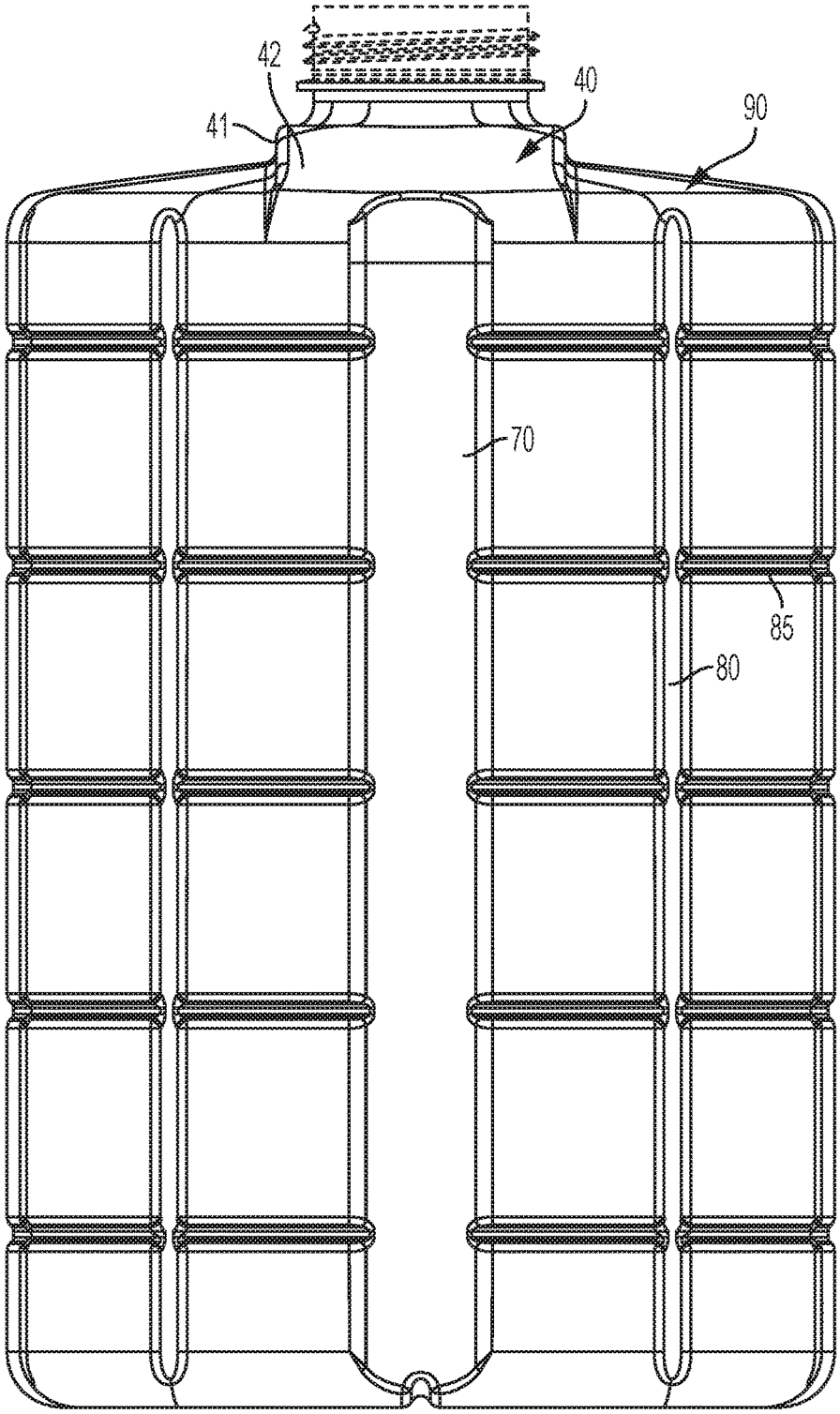
FIG. 12 is a side view of a container according to the fourth embodiment.
Figure 13:
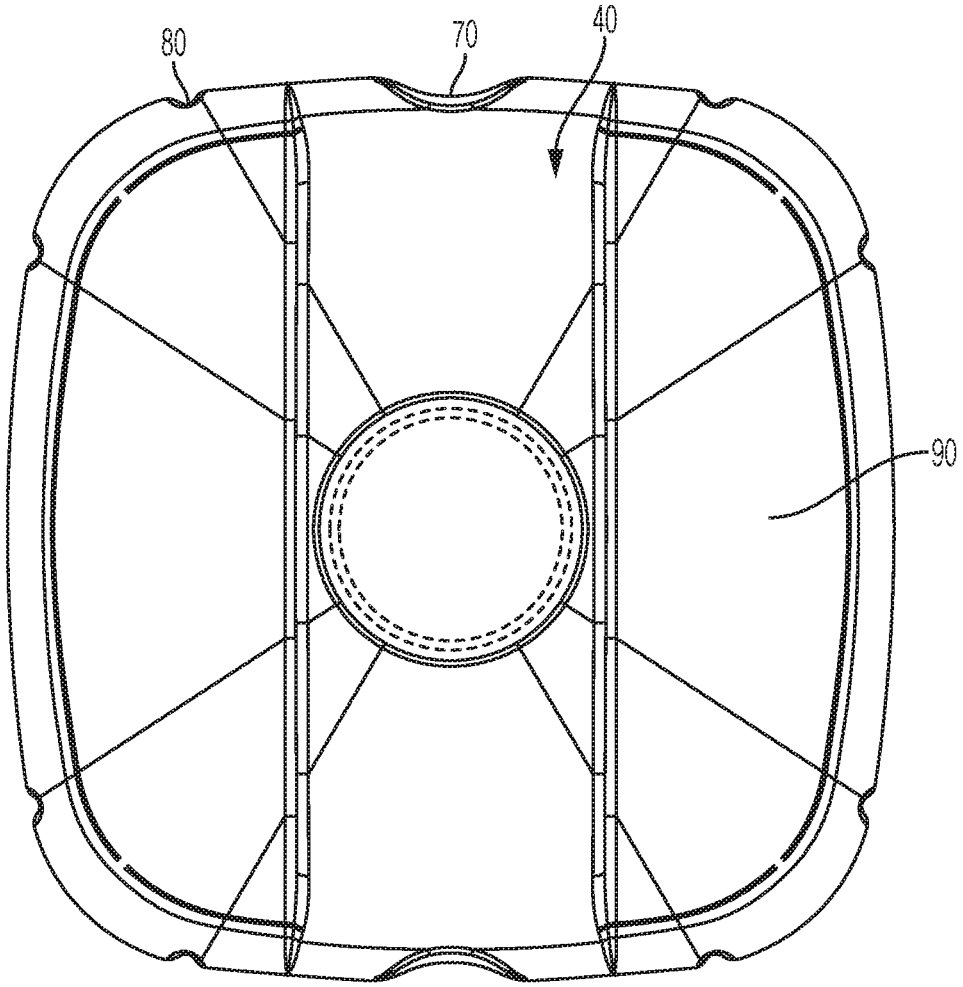
FIG. 13 is a top view of a container according to the fourth embodiment.
Figure 14:
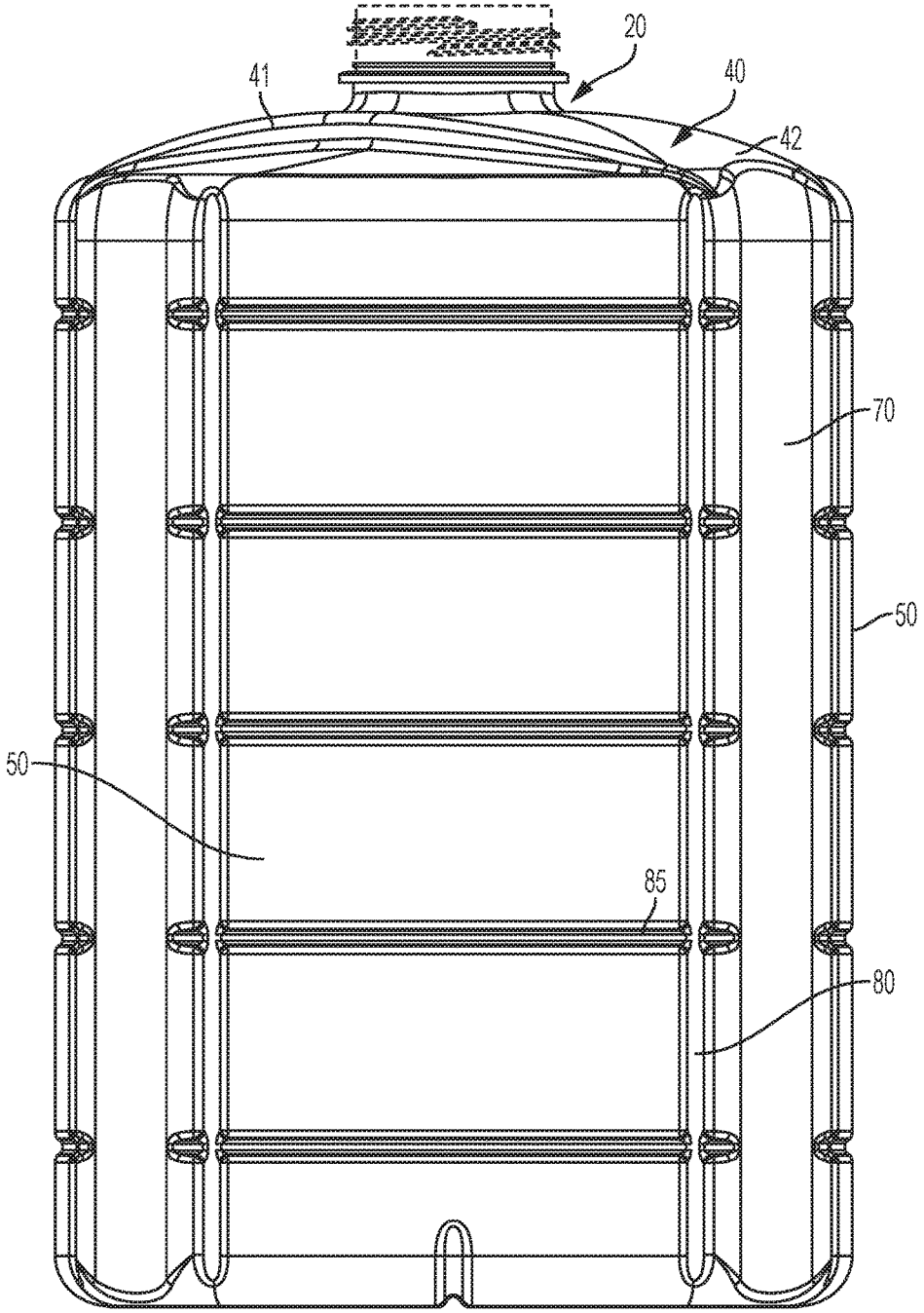
FIG. 14 is a front view of a container according to a fifth embodiment.

In another embodiment shown in FIGS. 8-10, the orientation of the shoulder ribs 40 and the vertical ribs 70 is changed to provide additional support for the neck 20. In this embodiment, the shoulder ribs 40 are oriented perpendicular to the sidewalls to reduce the length of the shoulder rib 40, which provides more direct support for the neck 20. Thus, the vertical ribs 70 are oriented at the center of the sidewalls 50 midway from where adjacent sidewalls intersect at the corner of the container 10. The vertical ribs 70 run from the shoulder portion 35 to the bottom of the container. Using this orientation improves the resistance to displacement of the neck 20 due to top loading as compared to the prior embodiments. Thus, as shown in FIG. 9, four shoulder ribs 40 are utilized to provide additional support for the neck 20 by transmitting the downforce on the neck 20 to vertical ribs 70 at the transition between the shoulder portion 35 to the sidewalls 50.

Additionally, this embodiment may include multiple horizontal side wall ribs 85 intersecting vertical sidewall ribs 80 to provide for additional support. The dimension of these ribs is the same as set forth above.

In another embodiment illustrated in FIGS. 11-14, vertical ribs 70 are used on combination with shoulder ribs 40 to provide improved neck support. However, in this embodiment, only two shoulder ribs 40 are provided. These shoulder ribs 40 extend to opposite sidewalls 50 of the container 10 from the neck 20. Also, adjoining each of these shoulder ribs 40 is a corresponding vertical rib 70 that extends down the sidewall to the bottom of the container. These should ribs 40 may be dimensioned similarly to the shoulder ribs of the other embodiments, but in this embodiment these ribs are about twice the width of the other disclosed ribs. The corresponding vertical ribs 70 are sized and structured similar as in the previously described embodiments.

Figure 15:
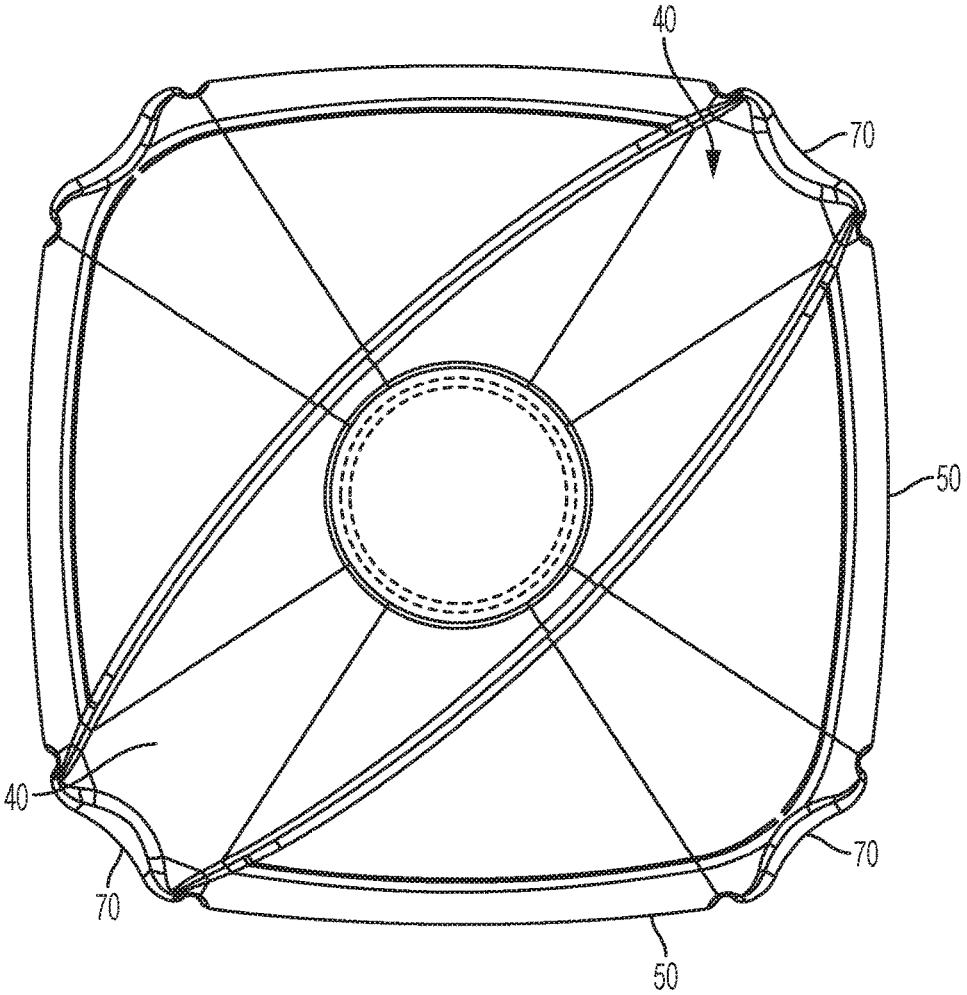
FIG. 15 is a top view of a container according to the fifth embodiment.
Figure 16:
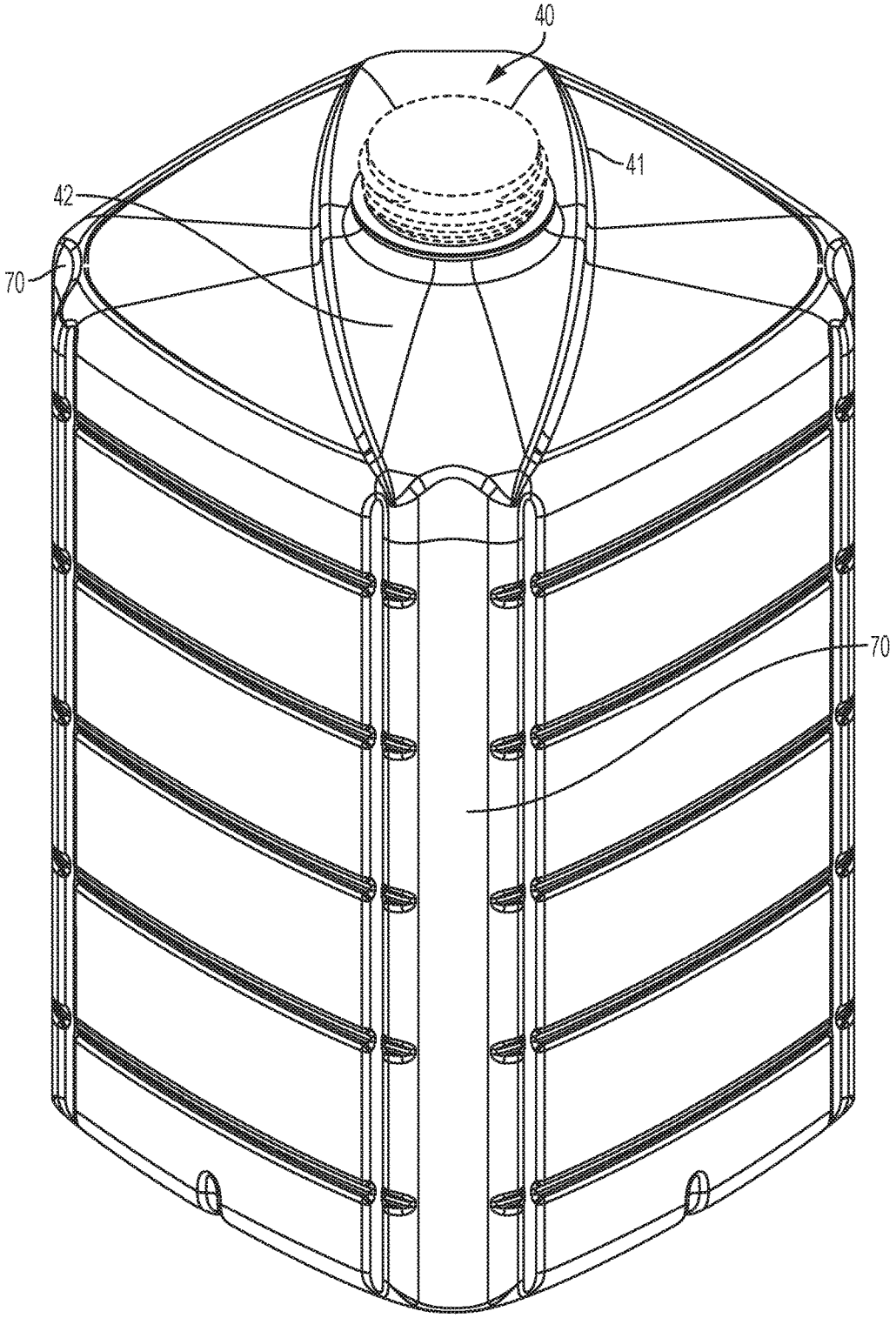
FIG. 16 is a perspective view of a container according to the fifth embodiment.

In another embodiment as shown in FIGS. 15-17, a shoulder rib and vertical rib structure similar to FIGS. 11-14 is shown. However, in this embodiment, the shoulder rib 70 extends from the neck 20 toward a corner where adjacent sidewalls 50 intersect. The vertical rib 70 runs down the corner of container 10 where the sidewalls meet as in the other embodiments.

While this invention has been particularly shown and described with reference to exemplary embodiments thereof, the above description should be considered as illustrations of the exemplary embodiments only and are not for purposes of limitation. Therefore, the scope of the invention is defined not by the detailed description of the invention but by the appended claims, and all differences within the scope will be construed as being included in the present invention.

What is claimed is:

1. A blow molded container comprising:

a bottom;

four sidewalls extending upward from the bottom to a shoulder region;

a neck disposed on the shoulder region and defining an opening at the top of the container; and vertical ribs extending from the shoulder region to the bottom along the sidewalls, the vertical ribs each being positioned between a pair of sidewall vertical ribs, wherein the shoulder region includes shoulder ribs and a shoulder base portion, the shoulder ribs formed of shoulder rib walls extending upward from the shoulder base portion and a shoulder rib top portion extending between the shoulder rib walls to form an upper part of the shoulder ribs, wherein each shoulder rib extends from the neck to an upper part of a corresponding vertical rib, the container comprising horizontal ribs that each extend through two of the sidewall vertical ribs and do not extend across central portions of the vertical ribs, and wherein one shoulder rib extends from the neck to a rib of one of the sidewalls and another shoulder rib extends from the neck to a rib of a sidewall opposite the one of the sidewalls and the corresponding vertical rib for each of the shoulder ribs extends downward along the rib of the corresponding sidewall.

2. The blow molded container according to claim 1, wherein one shoulder rib extends from the neck to a point of intersection between two adjacent sidewalls and another shoulder rib extends from the neck to a point of intersection between the other two adjacent sidewalls and the corresponding vertical rib for each of the shoulder ribs extends along the point of intersection of the adjacent sidewalls.

3. The blow molded container according to claim 1, wherein a corresponding shoulder rib extends from the neck to a point of intersection between each of two adjacent sidewalls of the four sidewalls and a corresponding vertical rib for each of the shoulder ribs extends along the point of intersection of the adjacent sidewalls.

4. The blow molded container according to claim 1, wherein the ribs of each of the sidewalls extend parallel to the vertical ribs.

5. The blow molded container according to claim 1, wherein the shoulder ribs have a convex shape and the corresponding vertical ribs have a concave shape.

6. The blow molded container according to claim 2, wherein the shoulder ribs have a convex shape and the corresponding vertical ribs have a concave shape.

7. The blow molded container according to claim 1, wherein the shoulder ribs have a convex shape and the corresponding vertical ribs have a concave shape.

8. The blow molded container according to claim 3, wherein the shoulder ribs have a convex shape and the corresponding vertical ribs have a concave shape.

9. The blow molded container according to claim 4, wherein the shoulder ribs have a convex shape and the corresponding vertical ribs have a concave shape.

10. The blow molded container according to claim 1, wherein the shoulder ribs have a convex shape and the corresponding vertical ribs are comprised of a plurality of convex and concave shapes.

11. The blow molded container according to claim 10, wherein two adjacent shoulder rib portions are joined by a shoulder bridge portion extending between the adjacent shoulder ribs and the height of the shoulder bridge portion is the same as the height of the adjacent shoulder ribs.

12. A blow molded container comprising:

a bottom;

four sidewalls extending upward from the bottom to a shoulder region;

a neck disposed on the shoulder region and defining an opening at the top of the container; and vertical ribs extending from the shoulder region to the bottom along the sidewalls, the vertical ribs each being positioned between a pair of sidewall vertical ribs that extend parallel to the vertical ribs, wherein the shoulder region includes shoulder ribs and a shoulder base portion, the shoulder ribs formed of shoulder rib walls extending upward from the shoulder base portion and a shoulder rib top portion extending between the shoulder rib walls to form an upper part of the shoulder ribs, wherein each shoulder rib extends from the neck to an upper part of a corresponding vertical rib, the container comprising horizontal ribs that each extend through two of the sidewall vertical ribs and do not extend across central portions of the vertical ribs, wherein the shoulder ribs have a convex shape and the corresponding vertical ribs are comprised of a plurality of convex and concave shapes, and wherein two adjacent shoulder rib portions are joined by a shoulder bridge portion extending between the adjacent shoulder ribs and the height of the shoulder bridge portion is the same as the height of the adjacent shoulder ribs.

13. The blow molded container according to claim 12, wherein one shoulder rib extends from the neck to a point of intersection between two adjacent sidewalls and another shoulder rib extends from the neck to a point of intersection between the other two adjacent sidewalls and the corresponding vertical rib for each of the shoulder ribs extends along the point of intersection of the adjacent sidewalls.

14. The blow molded container according to claim 12, wherein a corresponding shoulder rib extends from the neck to a point of intersection between each of two adjacent sidewalls of the four sidewalls and a corresponding vertical rib for each of the shoulder ribs extends along the point of intersection of the adjacent sidewalls.

15. The blow molded container according to claim 12, wherein a corresponding shoulder rib extends from the neck to a rib of each of the sidewalls and the corresponding vertical rib for each of the shoulder ribs extends downward along the rib of the corresponding sidewall.

16. A blow molded container comprising:

a bottom;

a plurality of sidewalls, the sidewalls each extending upward from the bottom to a shoulder region;

a neck disposed on the shoulder region and defining an opening at the top of the container; and vertical ribs extending from the shoulder region to the bottom along the sidewalls, the vertical ribs each being positioned between a pair of sidewall vertical ribs that extend parallel to the vertical ribs, wherein the shoulder region includes shoulder ribs and a shoulder base portion, the shoulder ribs formed of shoulder rib walls extending upward from the shoulder base portion and a shoulder rib top portion extending between the shoulder rib walls to form an upper part of the shoulder ribs, wherein each shoulder rib extends from the neck to an upper part of a corresponding vertical rib, the container comprising horizontal ribs that each extend through two of the sidewall vertical ribs and into one of the vertical ribs such that the horizontal ribs do not extend across central portions of the vertical ribs, and wherein one shoulder rib extends from the neck to a rib of one of the sidewalls and another shoulder rib extends from the neck to a rib of a sidewall opposite the one of the sidewalls and the corresponding vertical rib for each of the shoulder ribs extends downward along the rib of the corresponding sidewall.

17. The blow molded container according to claim 16, wherein the shoulder ribs have a convex shape and the corresponding vertical ribs have a concave shape.

18. The blow molded container according to claim 16, wherein the shoulder ribs have a convex shape and the corresponding vertical ribs are comprised of a plurality of convex and concave shapes.

19. The blow molded container according to claim 18, wherein two adjacent shoulder rib portions are joined by a shoulder bridge portion extending between the adjacent shoulder ribs and the height of the shoulder bridge portion is the same as the height of the adjacent shoulder ribs.

20. The blow molded container according to claim 1, wherein the central portions each extend from the bottom to the shoulder region.

* * * * *